US005457001A

United States Patent [19]

Van Ritter

[11] Patent Number: 5,457,001

[45] Date of Patent: Oct. 10, 1995

[54] ELECTRICALLY CONDUCTIVE TONER POWDER

[75] Inventor: Hendrik R. P. Van Ritter, Rl Eindhoven, Netherlands

[73] Assignee: OCE'-Nederland, B.V., Venlo, Netherlands

[21] Appl. No.: 280,821

[22] Filed: Jul. 26, 1994

[30] Foreign Application Priority Data

Jul. 26, 1993 [NL] Netherlands ..... 9301307

[51] Int. Cl.[6] ..... G03G 9/097

[52] U.S. Cl. ..... 430/110; 430/138

[58] Field of Search ..... 430/110, 138

[56] References Cited

U.S. PATENT DOCUMENTS

| | | | |
|---|---|---|---|
| 3,563,734 | 2/1971 | Shely | 430/126 |
| 3,639,245 | 2/1972 | Nelson | 430/110 |
| 5,162,188 | 11/1992 | Wilson et al. | 430/110 |
| 5,382,491 | 1/1995 | Diaz et al. | 430/110 |

FOREIGN PATENT DOCUMENTS

| | | |
|---|---|---|
| 0310209 | 4/1989 | European Pat. Off. . |
| 0441426 | 8/1991 | European Pat. Off. . |
| 2931087 | 2/1980 | Germany . |
| 3542701 | 6/1986 | Germany . |
| 2120865 | 8/1990 | Japan . |
| 1406983 | 9/1975 | United Kingdom . |
| 9222911 | 12/1992 | WIPO . |

*Primary Examiner*—Roland Martin
*Attorney, Agent, or Firm*—Birch, Stewart, Kolasch & Birch

[57] ABSTRACT

An electrically conductive toner powder, the separate particles of which contain thermoplastic resin, additives conventional in toner powders, such as coloring constituents and possibly magnetically attractable material, and an electrically conductive protonized polyaniline complex, the protonized polyaniline complex preferably having an electrical conductivity of at least 1 S/cm, the conductive complex being distributed over the volume of the toner particles or is present in a polymer-matrix at the surface of the toner particles.

6 Claims, No Drawings

ELECTRICALLY CONDUCTIVE TONER POWDER

BACKGROUND OF THE INVENTION

1. Field of the Invention

The invention relates to an image development toner powder and, more specifically, to a toner powder which is utilized in the development of electrostatic, electrophotographic and magnetographic images.

2. Discussion of Related Art

In electrostatography and electrophotography it is known to form a visible image by using electrically conductive toner powder having a resistivity of less than $10^{12}$ Ω.cm, preferably between $10^4$ and $10^9$ Ω.cm, measured as described in Example 1 of UK patent 1,406,983. Examples of image-forming processes in which such electrically conductive toner powder is used will be found inter alia in the above mentioned UK patent 1,406,983, European patent 0,310,209 and U.S. Pat. No. 3,563,734.

Electrically conductive magnetically attractable toner powders can also be advantageously used in magnetographic image-forming processes, as described inter alia in U.S. Pat. No. 5,154,944.

Electrically conductive toner powders usually consist of thermoplastic resin particles in which additives, such as coloring constituents and possibly magnetically attractable material, are present in finely divided or dissolved form and which contain electrically conductive material distributed over the volume of the particles and/or applied to or just beneath the surface of the particles. One electrically conductive material which is frequently used is carbon, the carbon particles preferably being affixed to the surface of the toner particles or being embedded completely or partially in the surface thereof. At the same time the carbon particles act as a coloring constituent. Examples of these toner powders are described in UK patent 1,406,983 and U.S. Pat. No. 3,639,245. For electrically conductive colored toner powders, use is made of electrically conductive colorless, relatively transparent substances, for example tin oxide which, to increase the electrical conductivity, is doped with antimony or fluorine. In this case too, the conductive material is preferably deposited on the surface of the toner particles. See published European patent application 0,441,426.

Deposition of the conductive powder material on the surface of the toner particles has the advantage that relatively little material is required, usually not more than 8% by weight, to achieve the required electrical conductivity. In the preparation of the toner powder it is necessary to ensure that virtually no loose conductive powder, i.e. not adhering to the surface, is present. The fine conductive powder can be deposited on the image-recording element, e.g., photoconductive or dielectric surface, so that the span of life thereof is greatly reduced. If the conductive powder is distributed over the volume of the toner particles, the required electrical conductivity is often only achieved at weight percentages of conductive powder of more than 25. These large quantities of conductive powder in turn have an adverse effect on the heat-fixing properties of the toner powder.

SUMMARY OF THE INVENTION

Therefore, the object of the present invention is to provide an electrically conductive toner powder which will overcome the above-noted disadvantages.

The present invention relates to a toner powder which, in addition to a thermoplastic binder and other additives conventional in toner powders, e.g., magnetically attractable material and/or coloring constituents, contain electrically conductive material to give the toner powder the required electrical conductivity so that it can be deposited on a charge or potential pattern by inductive attraction. More specifically, the electrically conductive toner contains a complex of a polyaniline and a protonizing acid as conductive material.

DETAILED DISCUSSION OF THE INVENTION

The toner powder according to the present invention contains conductive material in the form of a polymeric compound deposited in a thin polymer-matrix on the surface of the toner particles or distributed as a conductive matrix in the volume of the toner particles. Suitable polyanilines and complexing protonizing acids which can be used in combination therewith are described in International patent application WO 92/22911. Suitable polyanilines are those according to anyone of the general formulas I, II, III or IV:

I

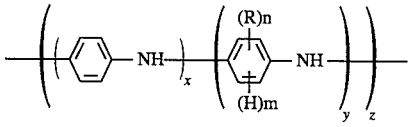

II

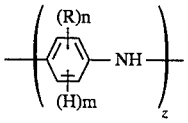

III

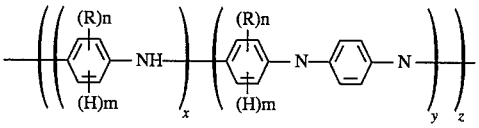

IV

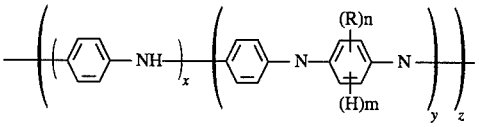

wherein n is an integer from 0–4 m is an integer from 0–4 with the proviso that the sum of n+m equals 4 y is an integer equal to or greater than 0 x is an integer equal to or greater than 1, with the proviso that x+y is greater than 1 z is an integer equal to or greater than 1.

R is independently selected so as to be the same or different at each occurrence and is selected from the group consisting of alkyl, alkenyl, alkoxy, cycloalkyl, cycloalkenyl, alkanoyl, alkylthio, aryloxy, alkylthloalkyl, alkylaryl, arylalkyl, amino, alkylamino, dialkylamino, aryl, alkylsulfinyl, alkoxyalkyl, alkylsulfonyl, arylthio, arylsulfinyl, alkoxycarbonyl, arylsulfonyl, carboxylic acid, halogen, cyano, or alkyl substituted with one or more sulfonic acid, carboxylic acid, halogen, nitro, cyano or epoxy moieties; or any two R groups together may form an alkylene or alkenylene chain completing a 3, 4, 5, 6 or 7 membered aromatic or alicyclic ring, which ring may optionally include one or more divalent nitrogen, sulfur or oxygen atoms.

Suitable protonizing acids are those of formulas V and VI $$A-R_1 \qquad V$$

VI

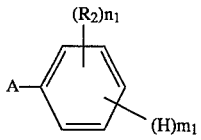

wherein:

A is sulfonic acid, selenic acid, phosphonic acid, boric acid or a carboxylic acid group; or hydrogen sulfate, hydrogen selenate, hydrogen phosphate;

$n_1$ is an integer from 0 to 5;

$m_1$ is an integer from 0 to 4 with the proviso that the sum of n+m is 5;

$R_1$ is alkyl, alkenyl, alkoxy, alkanoyl, alkylthio, alkylthioalkyl, having from 1 to about 20 carbon atoms; or alkylaryl, arylalkyl, alkylsulfinyl, alkoxyalkyl, alkylsufonyl, alkoxycarbonyl, carboxylic acid, where the alkyl or alkoxy has from 0 to about 20 carbon atoms; or alkyl having from 3 to about 20 carbon atoms substituted with one or more sulfonic acid, carboxylic acid, halogen, nitro, cyano, diazo, or epoxy moieties; or a substituted or unsubstituted 3, 4, 5, 6 or 7 membered aromatic or alicyclic carbon ring, which ring may include one or more divalent heteroatoms of nitrogen, sulfur, sulfinyl, sulfonyl or oxygen such as thiophenyl, pyrolyl, furanyl, pyridinyl. In addition to these monomeric acid forms, $R_1$ can be a polymeric backbone from which depend a plurality of acid functions "A". Examples of polymeric acids include sulfonated polystyrene, sulfonated polyethylene and the like. In these cases the polymer backbone can be selected either to enhance solubility in nonpolar substrates or be soluble in more highly polar substrates in which materials such as polymers, polyacrylic acid or poly(vinylsulfonate), or the like, can be used.

$R_2$ is the same or different at each occurrence and is alkyl, alkenyl, alkoxy, cycloalkyl, cycloalkenyl, alkanoyl, alkylthio, aryloxy, alkylthioalkyl, alkylaryl, arylalkyl, alkylsulfinyl, alkoxyalkyl, alkylsufonyl, aryl, arylthio, arylsuffinyl, alkoxycarbonyl, arylsulfonyl, carboxylic acid, halogen, cyano, or alkyl substituted with one or more sulfonic acid, carboxylic acid, halogen, nitro, cyano or epoxy moieties; or any two R substituents taken together are an alkylene or alkenylene group completing a 3, 4, 5, 6 or 7 membered aromatic or alicyclic carbon ring or multiples thereof, which ring or rings may include one or more divalent heteroatoms of nitrogen, sulfur, sulfinyl, sulfonyl or oxygen.

$R_2$ typically has from about 1 to about 20 carbons, preferably 3 to 20 and more preferably from about 8 to 20 carbons.

Preferred for use in the practice of this invention are functionalized protonic acid solutes of the above Formulas V and VI in which:

A is sulfonic acid, phosphonic acid or carboxylic acid;

$n_1$ is an integer from 1 to 5;

$m_1$ is an integer from 0 to 4 with the proviso that the sum of n+m=5;

$R_1$ is alkyl, alkenyl, alkoxy, alkylthio, alkylthioalkyl, having from 5 to about 16 carbon atoms; or alkylaryl, arylalkyl, alkylsulfinyl, alkoxyalkyl, alkylsulfonyl, alkoxycarbonyl, carboxylic acid where the alkyl or alkoxy has from 1 to about 20 carbon atoms; or alkyl having from 3 to about 20 carbon atoms substituted with one or more sulfonic acid, carboxylic acid, halogen, nitro, cyano, diazo, or epoxy moieties;

$R_2$ is the same or different at each occurrence and is alkyl, alkenyl, alkoxy, arylalkyl, alkylsulfinyl, alkoxycarbonyl or carboxylic acid having from 3 to 12 carbon atoms, or alkyl substituted with one or more carboxylic acid, halogen, diazo or epoxy moieties.

Among the materials mentioned for use in toner powder according to the invention, the protonized polyanilines having a conductivity of more than 1 S/cm have proved to be particularly suitable. Examples of such protonized polyanilines are polyaniline emeraldine salt protonized with methanesulfonic acid (71 S/cm); ethane sulfonic acid (35.5 S/cm); (L,D) camphor sulfonic acid (2.7 S/cm); p-toluene sulfonic acid (22 S/cm); 4-dodecyl benzene sulfonic acid; p-hydroxybenzene sulfonic acid (6.3 S/cm); bis (2-ethyl lexyl hydrogen phosphate (7 S/cm). The choice of conductive polyaniline complex is also determined by the thermoplastic resin or resin mixture used as the main constituent or binder of the toner powder.

Of course, a polyaniline complex should be used that is compatible with the toner resin (or the toner resin mixture) and preferably a polyaniline complex is used which can be so finely distributed in a melt of the toner resin as to give a conductive end product. Thus, given the correct choice of the polyaniline complex, the toner powder according to the present invention can be prepared in a simple manner by melting the thermoplastic resin or resins forming the main constituent of the toner powder and distributing, in the melt, the required additives, such as magnetizable material and/or coloring constituents, together with the protonized complex of the polyaniline and protonizing acid. After cooling of the melt, the material is ground to give toner particles of the required particle size.

In combination with epoxy and phenoxy resins, polyester resins derived from an alkoxylated bisphenol and a dicarboxylic acid, such as fumaric acid, and mixtures of epoxy and polyester resins, which are frequently used in toner powders, polyaniline complexes of polyaniline emeraldine, protonized with camphor sulphonic acid or dodecylbenzene sulphonic acid, are particularly attractive.

Apart from mixing in the resin melt, toner powders according to the invention can be produced by dissolving the thermoplastic resin in a suitable, preferably polar, solvent, distributing the protonized polyaniline complex, or the polyaniline and protonizing acid, in the solution, then distributing the other additives in the liquid, and then evaporating the solvent and grinding the solid material to give toner particles of the required size. An alternative to evaporating the solvent and grinding the solid is spray-drying of the dispersion.

Volume-conducting toner powders can be prepared in the above-described manner with only 5–10% by weight of polyaniline complex being required to achieve the required electrical resistivity of the toner powder (usually between $10^4$–$10^9$ Ω.cm). In this way, according to the invention, toner powders having good heat-fixing properties are obtained.

A toner powder can also be prepared by preparing thermoplastic resin cores in which the additives, including magnetizable material and coloring material, are finely distributed and then coating these thermoplastic resin cores with a conductive polymer-matrix, preferably consisting of 5–10% by weight of a protonized polyaniline complex and 90–95% by weight of the same thermoplastic resin as present in the cores themselves. In this way surface-conductive toner powder is obtained which is free of fine electrically conductive powder dust.

Since the protonized polyaniline complexes used according to the invention are practically colorless, they are particularly suitable for preparing electrically conductive colored toner powders.

PREFERRED EMBODIMENTS

The following examples are intended to illustrate, but not limit, the subject matter of the present invention.

EXAMPLE 1

100 g of polyester resin (Atlac 500 T of ICI, England) are melted, whereupon there are added to the melt and distributed thoroughly therein 9 g of protonized complex of polyaniline emeraldine and camphor sulphonic acid, prepared as described below. The following are then added to and homogeneously distributed in the melt: 33g of magnetizable pigment (type Bayferrox B 318 M of Bayer AG, Germany). After cooling, the solid mass is ground and sifted, particles having a size of between 10 and 25 micrometers being separated. The resulting toner powder had a resistivity of about $10^8$ Ω.cm and was usable with good results for magnetic brush development of latent charge images formed on a photoconductor element.

Preparation of the Protonized Polyaniline Complex

Polyaniline was prepared according to the method described by Y. Cao, A. Andereatta, A. J. Heeger and P. Smith, Polymer, 30 (1989) 2305: A solution of 40 ml of freshly distilled aniline (Aldrich), 50 ml of 35% HCl (Fisher) and 400 ml distilled water was prepared in an 1 L Erlenmeyer flask. The flask was placed in a cooling bath maintained at 0° C. Polymerization was effected by addition of an oxidant solution consisting of 46 g of $(NH_4)_2S_2O_8$ (Aldrich) and 100 ml of distilled water. After all oxidant was added (2 hrs.), the flask was capped and left stirring for an additional 3 hours. The precipitated polymer powder was recovered, filtered and washed with distilled water until the pH of the washing liquid was 6–7. Subsequently, the polymer was washed with methanol until the liquid was clear, and then with ethyl ether to eliminate residual water and methanol.

Finally, the polymer was dried in a vacuum at room temperature for 48 hours. Emeraldine base form of polyaniline was prepared by compensation of the polyaniline salt, 10 g of polyaniline salt was stirred with 1000 ml of 3% $NH_4OH$ solution during 2 hours at room temperature. The resulting emeraldine base was filtrated and washed by distilled water until the pH of washing liquid was 7–8. Subsequently, the polymer was washed by methanol until washing liquid was colorless and then, with methyl ether. The emeraldine base was dried in dynamic vacuum at room temperature for 48 hours. The resulting polymer was insoluble in all common non-polar or weakly polar solvents, and of high molecular weight; the inherent viscosity of the non-conducting polyaniline measured at 25° C. in 97% sulfuric acid, 0.1% w/w, was 1.2 dL/g.

The non-conductive form of polyaniline, 5.43 g (0.06M of aniline), was mixed thoroughly with 6.96 g (0.03 M of (±) —10— camphor sulfonic acid (DSA) (Aldrich) using an agate mortar and pestle in a dry bag filled with nitrogen. The molar ratio of CSA to aniline repeat unit was 0.5; sufficient to completely protonate the emeraldine base form into the conducting salt form.

EXAMPLE 2

160 g of polyester resin as used in Example 1 were melted, whereupon the following were homogeneously distributed in the melt:

20 g carbonyl iron having on average a particle size of about 3 micrometers 2.4 g Astra Phloxine 0.8 g Basonyl Rot 560-perchlorate 3.2 g Macrolex Fluorescent Yellow 10 GN.

After cooling, the mass was ground and sifted, particles having a size of between ±10 and ±20 micrometers being separated. The resulting cores were rapidly added with agitation to a solution of the following:

20 g polyester resin (Atlac 500T)

1.2 g complex of polyaniline and dodecylbenzenesulfonic acid, was prepared as described in Example 1; however, 9.79 g of dodecylbenzenesulfonic acid in place of 6.96 of CSA was used.

0.4 g Basonyl Rot 560-perchlorate 150 ml o-Cresol

The dispersion was then spray-dried. This gave toner powder of a red color with a resistivity of about $10^7$ Ω.cm.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

I claim:

1. An electrically conductive toner powder comprising separate particles which contain thermoplastic resin as a binder, and an electrically conductive material, wherein said electrically conductive material consists of a complex of polyaniline and a protonizing acid.

2. An electrically conductive toner powder according to claim 1, further including magnetizable material and/or coloring material.

3. A toner powder according to claim 1, wherein said polyaniline and a protonizing acid is distributed over the volume of said thermoplastic resin.

4. A toner powder according to claim 3, wherein said polyaniline and a protonizing acid is present in a quantity of between 5 and 10% by weight.

5. A toner powder according to claim 1, wherein said polyaniline and a protonizing acid is present in a polymer-matrix at the surface of said toner particles.

6. A toner powder according to claim 1, wherein said polyaniline and a protonizing acid has a conductivity of at least 1 S/cm.

* * * * *